US009745752B2

(12) United States Patent
Strabala et al.

(10) Patent No.: US 9,745,752 B2
(45) Date of Patent: Aug. 29, 2017

(54) CONCRETE PRODUCTS LOCKING CAGE SPACER

(71) Applicant: Hawkeye Concrete Products Co., Mediapolis, IA (US)

(72) Inventors: Dave Strabala, Mediapolis, IA (US); Curt Grimm, Wapello, IA (US)

(73) Assignee: HAWKEYEPEDERSHAAB CONCRETE TECHNOLOGIES, INC., Clayton, MO (US)

( * ) Notice: Subject to any disclaimer, the term of this patent is extended or adjusted under 35 U.S.C. 154(b) by 0 days.

(21) Appl. No.: 14/820,235

(22) Filed: Aug. 6, 2015

(65) Prior Publication Data

US 2016/0040442 A1 Feb. 11, 2016

Related U.S. Application Data

(60) Provisional application No. 62/034,405, filed on Aug. 7, 2014.

(51) Int. Cl.
*E04C 5/20* (2006.01)

(52) U.S. Cl.
CPC ..... *E04C 5/203* (2013.01); *E04C 5/208* (2013.01)

(58) Field of Classification Search
CPC ..... E04G 17/064; E04C 5/203; E04C 5/208
USPC ..... D8/354
See application file for complete search history.

(56) References Cited

U.S. PATENT DOCUMENTS 3,280,529 A * 10/1966 Reuss ..... E04C 5/203 52/677
3,348,347 A * 10/1967 Berry ..... E04C 5/203 52/309.1
3,449,882 A * 6/1969 Bigglestone ..... E04C 5/20 52/689
3,856,246 A * 12/1974 Sinko ..... F16L 3/222 138/112
3,913,187 A * 10/1975 Okuda ..... F16L 3/1075 24/16 PB
4,566,660 A * 1/1986 Anscher ..... F16L 3/13 24/453
5,347,787 A * 9/1994 Gavin ..... E04C 5/203 248/74.3
D362,382 S * 9/1995 Cloud ..... D8/354
5,927,043 A * 7/1999 Newkirk ..... B28B 7/0064 249/189
5,947,426 A * 9/1999 Kraus ..... B60R 16/0215 248/68.1
D447,931 S * 9/2001 Aitken ..... D8/354
(Continued)

FOREIGN PATENT DOCUMENTS

JP 2011-47260 * 3/2011 ..... E04C 5/203
JP 2011-127355 * 6/2011 ..... E04C 5/203

*Primary Examiner* — Michael Safavi
(74) *Attorney, Agent, or Firm* — Shuttleworth & Ingersoll, PLC; James C. Nemmers

(57) ABSTRACT

A spacer for spacing the reinforcing cage from the forms used in making concrete products. The spacer of the invention is made from plastic in the shape of a wheel with spokes that join an outer ring with an inner ring that engages a horizontal wire on the wire cage. The rings have gaps to provide for installation of the spacer on a cage wire. The gap in the outer ring is closed by a latch that when properly engaged, will lock the spacer in place on the wire, thus positively holding the spacer on the wire once it is locked in place.

3 Claims, 6 Drawing Sheets

(56) References Cited

U.S. PATENT DOCUMENTS

| | | | | |
|---|---|---|---|---|
| 6,385,938 | B1 * | 5/2002 | Gavin | E04C 5/203 52/677 |
| 7,451,579 | B2 * | 11/2008 | Azarin | E04C 5/203 248/74.3 |
| 7,802,762 | B2 * | 9/2010 | Bauer | B60R 16/0215 24/555 |
| 2006/0273226 | A1 * | 12/2006 | Jatzke | F16L 3/223 248/68.1 |
| 2007/0094993 | A1 * | 5/2007 | Azarin | E04C 5/203 52/677 |
| 2009/0165418 | A1 * | 7/2009 | Verelli | E04C 5/203 52/649.1 |
| 2011/0120045 | A1 * | 5/2011 | Gavin | E04C 5/203 52/677 |

* cited by examiner

CONCRETE PRODUCTS LOCKING CAGE SPACER

This application claims priority under 35 USC 119 to Provisional Patent Application Ser. No. 62/034,405 filed on Aug. 7, 2014, the contents of which are hereby incorporated by reference.

BACKGROUND OF THE INVENTION

It is well known in the art of manufacturing concrete pipe and other similar structures, such as manholes, box sections, catch basins, septic tanks and the like (hereinafter simply "product" or "products"), that a reinforcing wire cage is provided as reinforcement to produce a product of the required strength. In order to produce a quality concrete product, the reinforcing cage must be positioned within the concrete forms used to produce the product so that the cage will be a predetermined distance from the inside and outside walls of the finished product. Since the cage will be subjected to various forces during the product manufacturing process, it is important that the cage be properly positioned from the walls of the forms and that the required distance from the forms be maintained throughout the casting process. In order to accomplish the proper spacing, there are commonly provided spacing elements, called spacers, which can be fastened to the cage to space it from and maintain it the proper distance from the form walls.

In the casting process, an inner core and an outer jacket create an annular space that receives the wire cage. To properly position the wire cage, numerous spacers are placed on the wire cage. The spacers must be designed to resist the forces exerted on them during the casting process. If the spacers fall off during the casting process, the cage can move out of position, which can result in the finished product not meeting the product specifications. The two commonly used methods of producing concrete products create different forces on a reinforcing cage and thus upon the spacers installed on the wire cage. One of the common casting methods is the vibration process which involves lowering the jacket over the core after the wire cage is in place. Unless the spacers used are capable of resisting the downward axial forces applied as the jacket is lowered in place, the spacers can be dislodged or distorted. Another commonly used method of producing concrete products is the packer head process. In this process, the spacers installed on the wire cage must be capable of resisting not only the axial forces that occur, but also the forces upon the spacers as the cage twists during rotation of the packer head.

There are known and used a number of different spacers which have been designed in an attempt to resist all of the forces exerted upon the spacers during the casting process. Many spacers are formed from spring steel with an open hook at each end to provide for attaching the spacer to the reinforcing cage. Between the attaching hooks of the spacer there is typically formed a spacing nose to maintain the wire cage the proper distance from the forms. These steel spacers work well in most instances, but occasionally some of the spacers can become dislodged from the cage. Also, because of some new state requirements, steel spacers are no longer approved for use because the exposed metal can lead to rusting and result in rust spots and corrosion.

Some attempts have been made to improve the design and lower the cost of spacers by making them from plastic in the shape of a wheel with spokes and a central ring that engages a horizontal wire on the wire cage. These plastic spacers require no special tools to install. However, with known designs of this type, the forces exerted on them during the casting process may twist the spaces and cause some of them to fall off the wire cage.

There is therefore a need for an improved spacer useable in any of the known casting processes and designed so as to be capable of resisting forces in all directions so that the spacer cannot become dislodged and produce voids or other defects in the finished product. There is a further need for an inexpensive spacer that will permit easy and quick installation without the use of any special tools.

SUMMARY OF THE INVENTION

The spacer of the invention is made from plastic in the shape of a wheel with spokes that join an outer ring with a central ring that engages a horizontal wire on the wire cage. The plastic material allows limited bending of the spacer without breaking, and the central ring has a narrow slot that can be widened to provide for installation of the spacer on a cage wire. The outer ring also has an opening closed by a lock with an inter-locking mechanism or latch. Two protruding alignment bosses form a part of the latch to prevent it from twisting and disengaging. When the latch is properly engaged, the spacer will be locked in place on the wire by closing the inner ring around the wire of the reinforcement cage positively holding the spacer on the wire once it is locked in place.

DESCRIPTION OF THE PREFERRED EMBODIMENTS OF THE INVENTION

Figure 1:
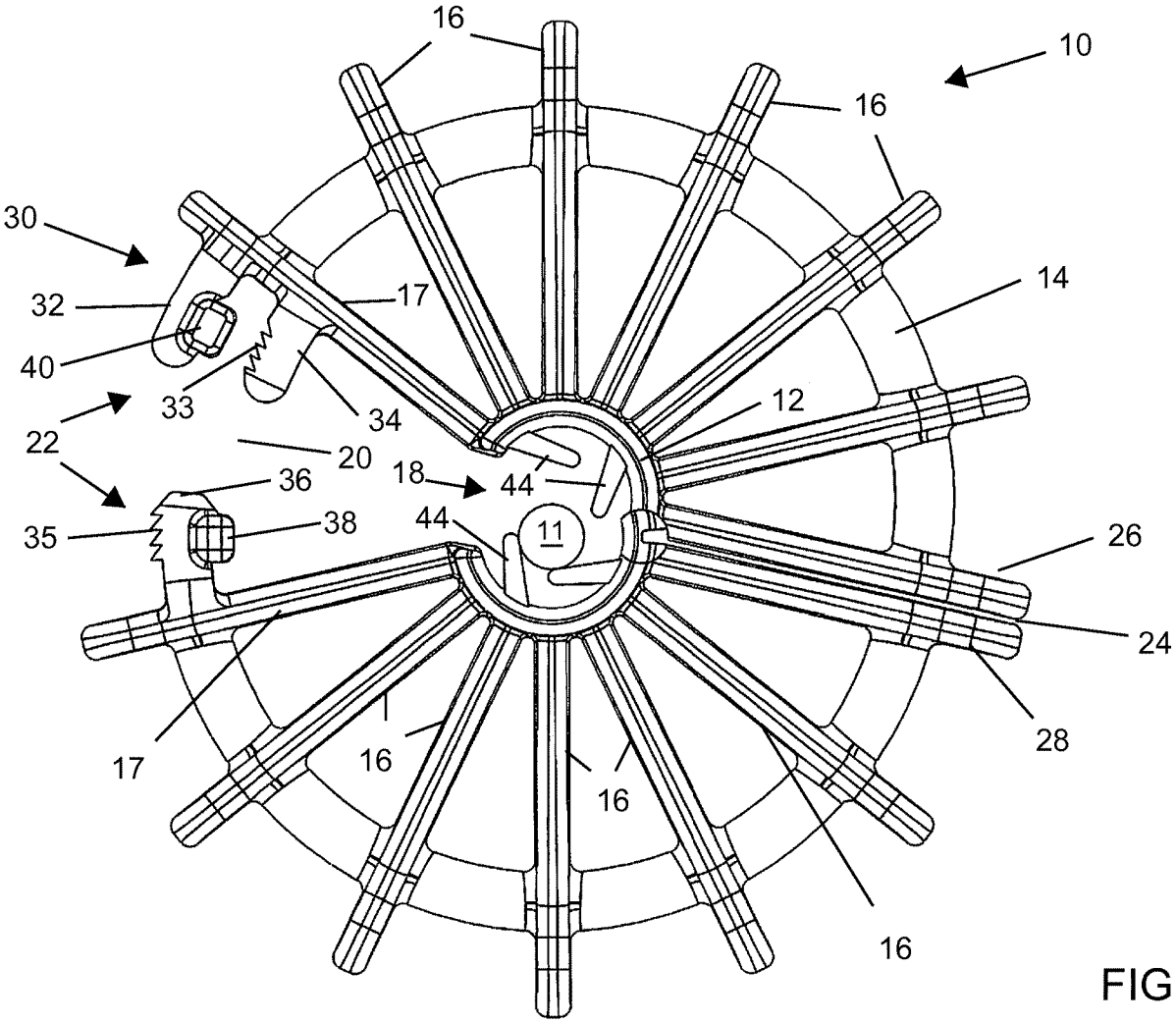
FIG. 1 is a side elevation view of a spacer constructed according to the principles of the invention showing the spacer opened and positioned on a horizontal reinforcing cage wire.

As is well known to those skilled in the art of manufacturing concrete pipe and other similar products, a reinforcing wire cage is positioned within the concrete forms used to produce the product so that the cage will be a predetermined distance from the inside and outside walls of the finished product. The reinforcing wire cage typically consists of a plurality of relatively uniformly spaced horizontal and vertical wires welded at their intersections to form the circular cage. In a typical cage, the nominal spacing between the wires is 2" or 3" although it may be more or less. The spacer of the invention, indicated generally by the reference numeral 10, is formed from plastic or other suitable material that is strong and rigid but sufficiently flexible that it can be flexed a limited distance without breaking during installation of the spacer 10 on a cage wire 11. The spacer 10 has an inner circular ring 12 forming a hub, the inner ring 12 being connected to an outer circular ring 14 by a plurality of spaced-apart spokes 16. Between two of the spokes 17 the inner ring 12 has a gap 18 which allows the inner ring 12 to be opened at the gap 18. Similarly, the outer ring 14 has a gap 20 between the two spokes 17 to accommodate a locking mechanism indicated generally by the reference numeral 22. Although the spokes 16 are generally evenly spaced apart, there is another gap 24 in the outer ring 14 between the two spokes 26 and 28 just opposite gap 20. This gap 24 provides for the opening of gaps 18 and 20, both of which must be open in order to install the spacer 10 on a cage wire. FIG. 1 shows the gap 24 almost closed when the gaps 18 and 20 are open to allow installation of the spacer 10 on a cage wire in the manner described hereinafter.

Each of the spokes 16, 26 and 28 extends radially outside of the outer ring 14, and the outer end of each spoke is rounded. With the spacers 10 installed on the wire reinforcement cage, the rounded ends of the spokes will assist lowering of the jacket during the casting process.

Figure 2:
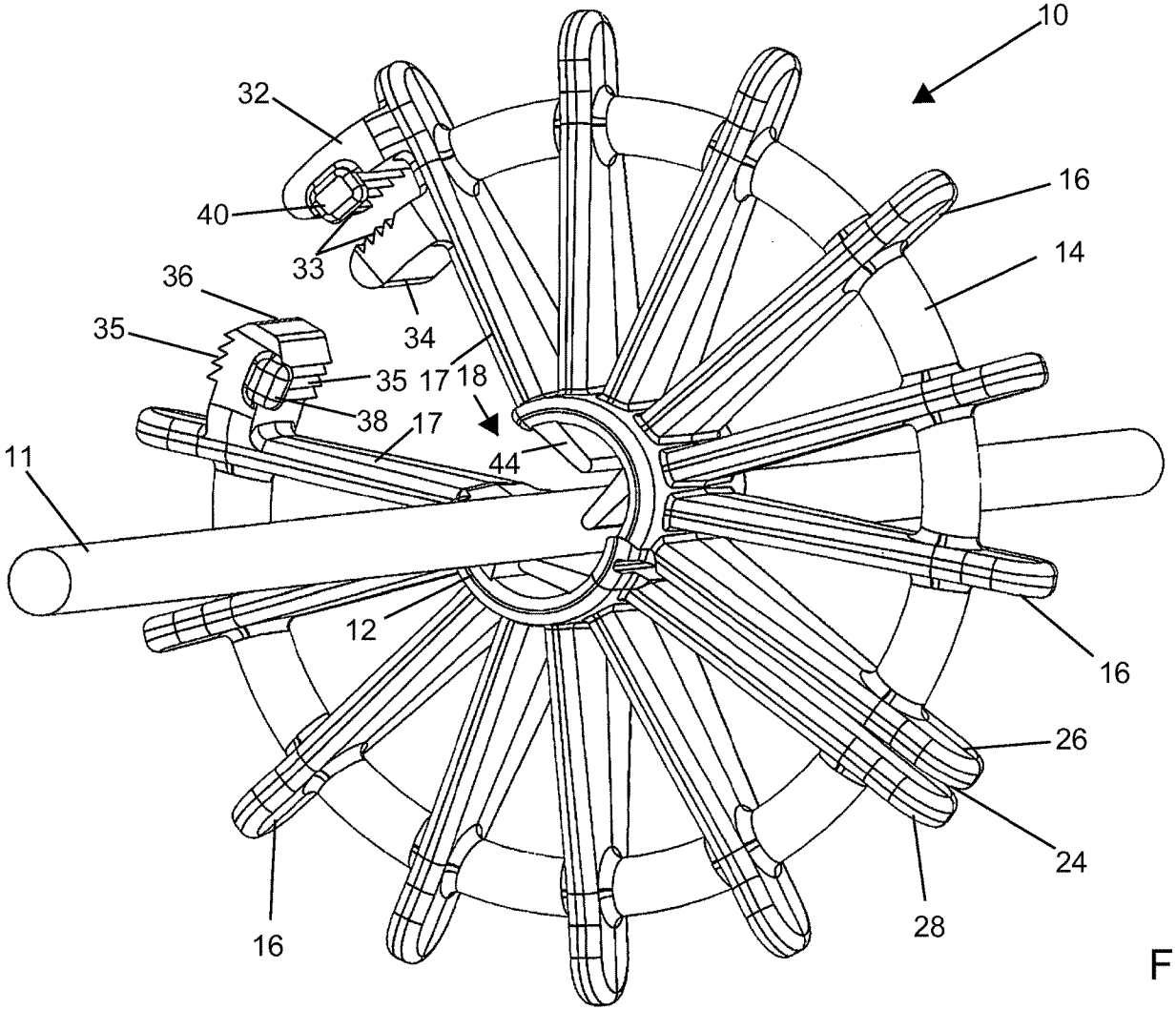
FIG. 2 is a perspective view of the spacer of FIG. 1.

The locking mechanism or latch 22 in the gap 20 includes a yoke 30 on one side of the gap 20. The yoke 30 has spaced-apart, circumferentially extending arms 32 and 34 each of which has a plurality of teeth 33 on its inside surface. On the opposite side of the gap 20 is a circumferentially extending arm 36 that will extend between the yoke arms 32 and 34 when the gap 20 is closed. As best seen in FIG. 2, arm 36 has teeth 35 on both outside surfaces which teeth 35 are aligned to engage with the teeth 33 on yoke arms 32 and 34. The teeth 33 on the yoke arms 32 and 34 and the teeth 35 on arm 36 are oriented so that when the teeth 33 and 35 are engaged, the yoke arms 32 and 34 are locked with the arm 36 and cannot be separated by force in the circumferential direction. In fact, the locking latch 22 has reverse draft so that the locking force produced by the latch will increase if force is applied in an attempt to unlock the latch 22. In addition, in order to prevent the arms 32, 34 from separating from arm 36 and thus unlocking the latch 22 if sufficient force is applied to the latch 22 in the axial direction, or if torsional force is exerted on the spacer 10 during the casting process, a boss 38 is provided on the side of arm 36 while a similar boss 40 is provided on the arm 32.

Figure 3:
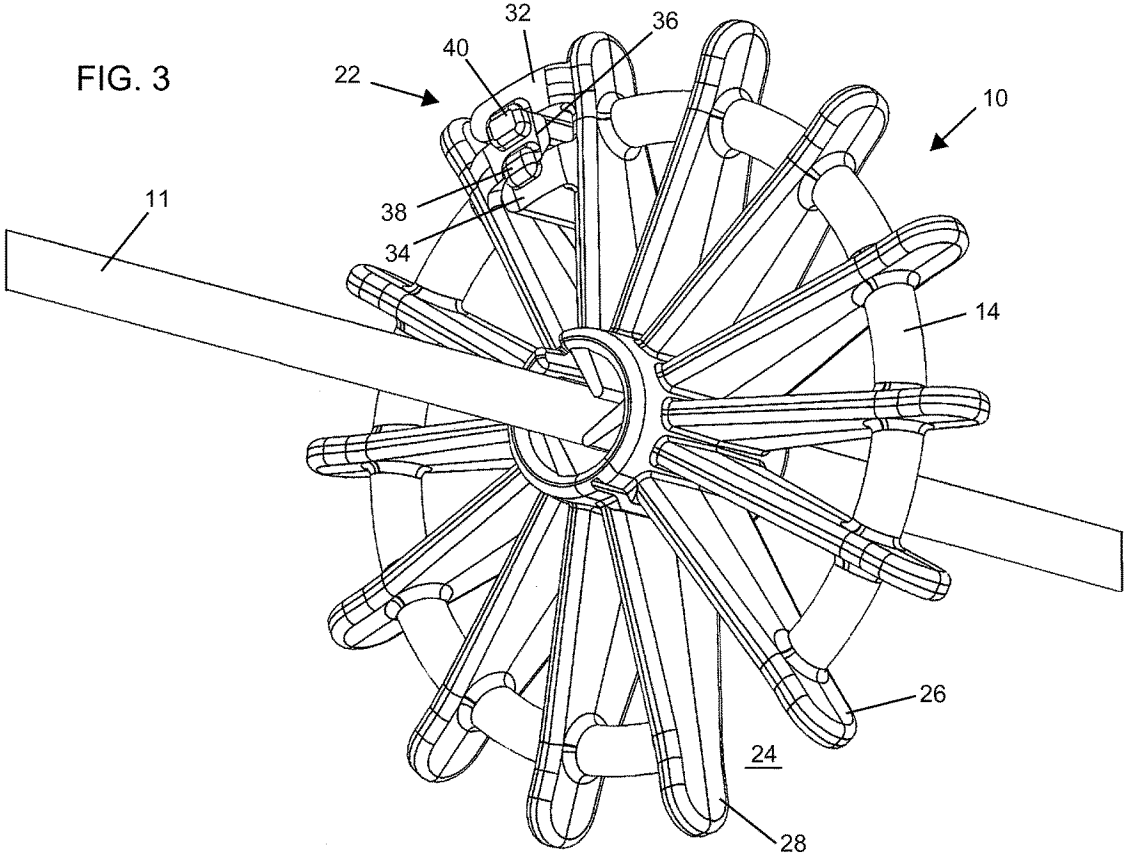
FIG. 3 a perspective view of the spacer showing the spacer fully mounted and locked on a wire of the cage.
Figure 4:
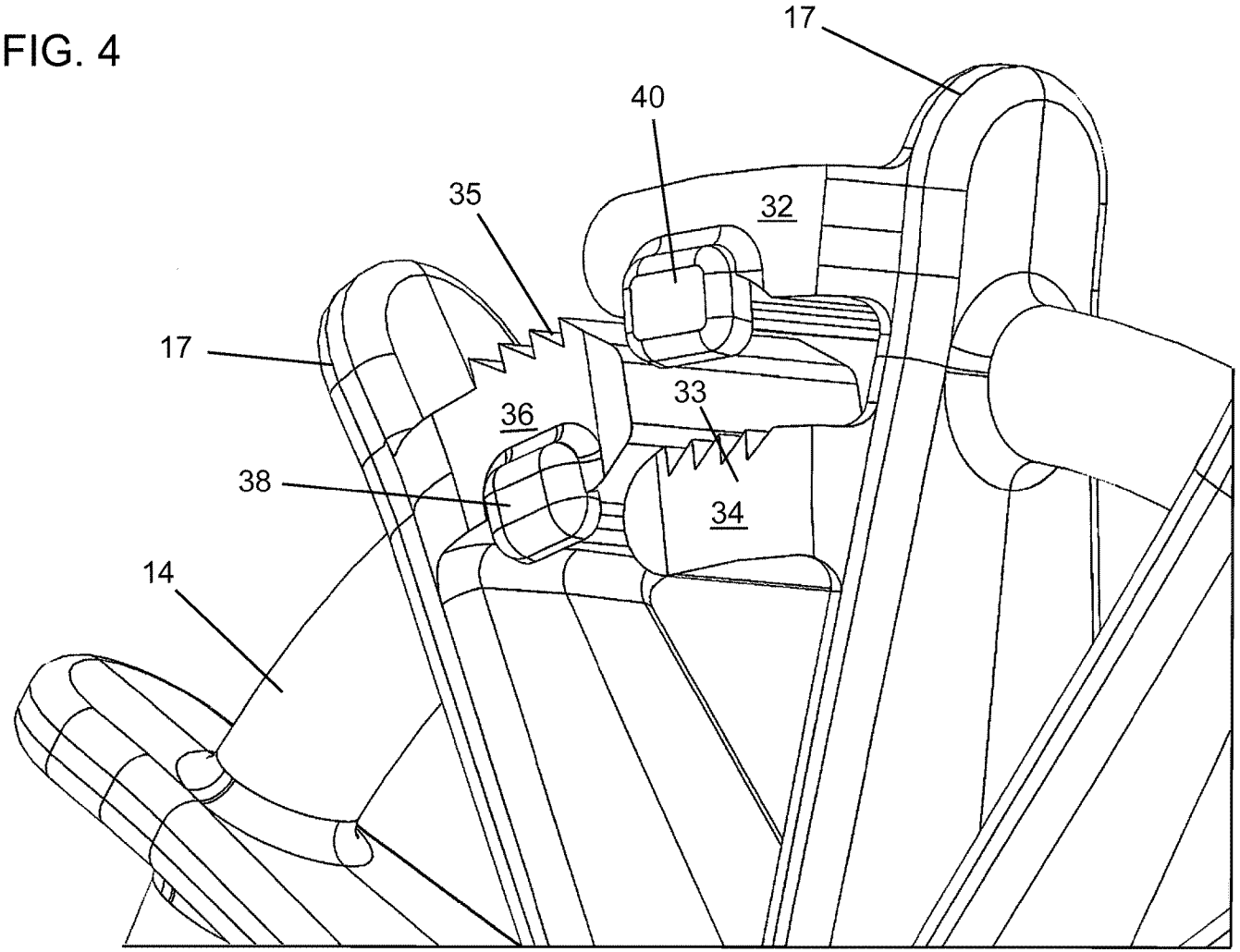
FIG. 4 is an enlarged perspective view of a portion of the spacer to illustrate the latch when in a unlocked position.
Figure 5:
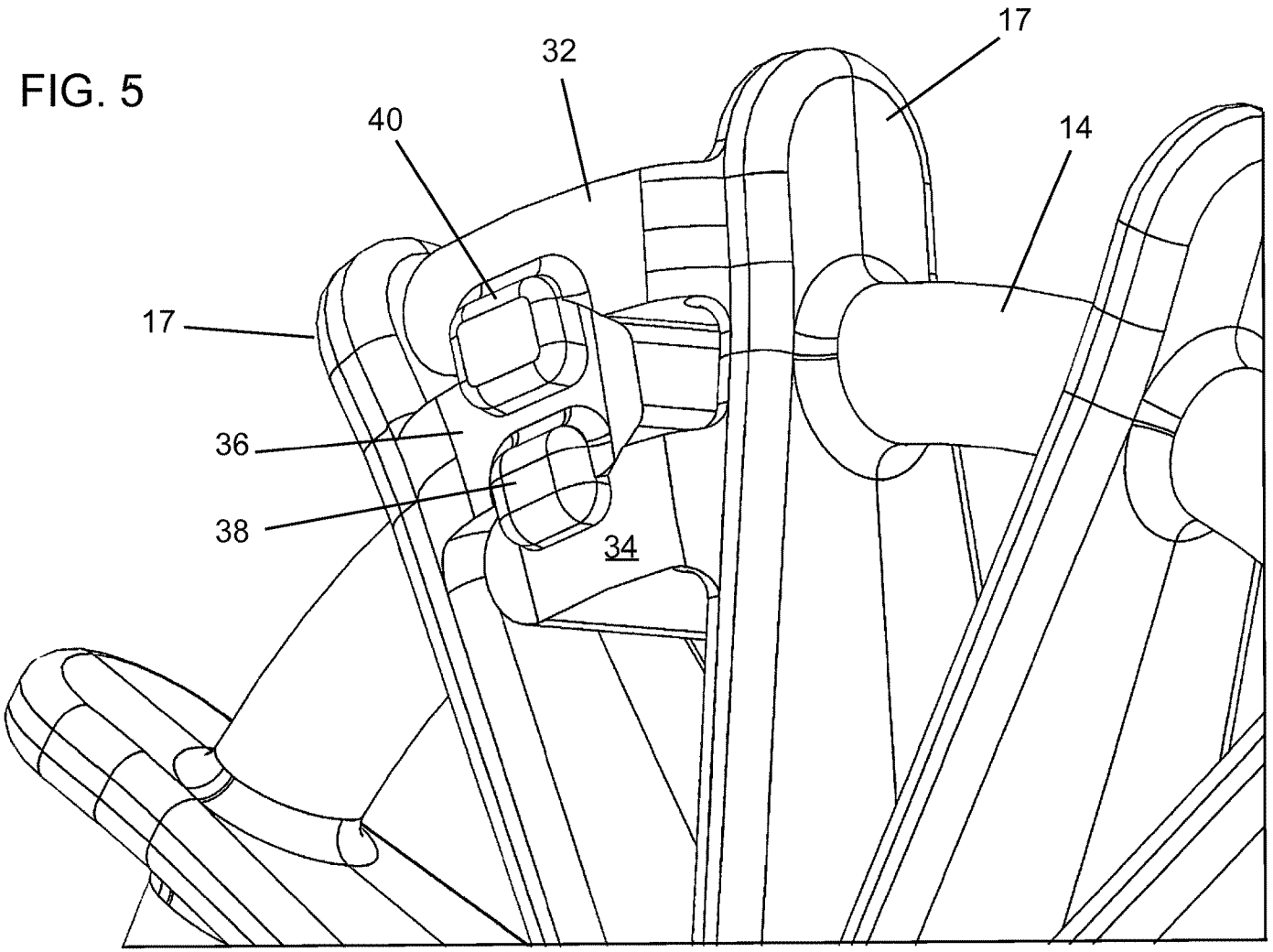
FIG. 5 is a perspective view of a portion of the spacer to better illustrate the bosses that maintain the latch in a locked position.

In order to assist in holding the spacer 10 on a horizontal cage wire 11 as the spacer is installed on the wire 11, four locking fingers 44 extend inwardly from the inner ring or hub 12, the locking fingers 44 extending substantially the entire width of the hub 12. The fingers 44 are spaced a substantially equal distance around the inside surface of hub 12, and each finger extends at about a 45° angle from a radial line. Thus, as best seen in FIGS. 1-3, when the spacer 10 is properly installed on the wire 11 with the latch 22 completely closed and therefore locked, the fingers 44 will extend and grip the sides of the wire 11 to keep the spacer 10 substantially centered. The width of hub 12 is substantially greater than the outer ring 14, which extra width minimizes twisting of the spacer 10 sideways.

In its normal condition prior to installation on a cage wire 11, the spacer is 'opened', i.e., the gaps 18 and 20 are open and gap 24 almost closed. To install the spacer 10 on a cage wire 11, the installer grips the spacer 10 between the fingers with the gap 20 in the outer ring 14 facing the wire 11. The spacer 10 is moved toward the wire 11 until the wire 11 is inside of the hub 12 and positioned in between the fingers 44. The installer then grips the spokes 17 adjoining the gap 20 and squeezes them together to force the arm 36 into the yoke arms 32 and 34 of the latch 22. This will cause the teeth 33 on the arms 32, 34 to engage the teeth 35 on arm 36 and lock the spacer 10 onto wire 11. Because of the angle of the teeth 33 and 35, the arm 36 cannot move circumferentially to disengage from the yoke arms 32, 34. Thus, with the spacer 10 locked in place on a horizontal wire 11, movement of the form jacket downwardly during the casting process will contact the outer rounded ends of the spokes 16. This movement may cause the spacer to turn about wire 11, but it cannot dislodge the spacer 10 from the wire 11. This turning of the spacer 10 during the casting process minimizes the amount of force on the spacer 10, and with the latch 22 locked, it is almost impossible for the spacer to become dislodged from the cage wire 11.

Figure 6:
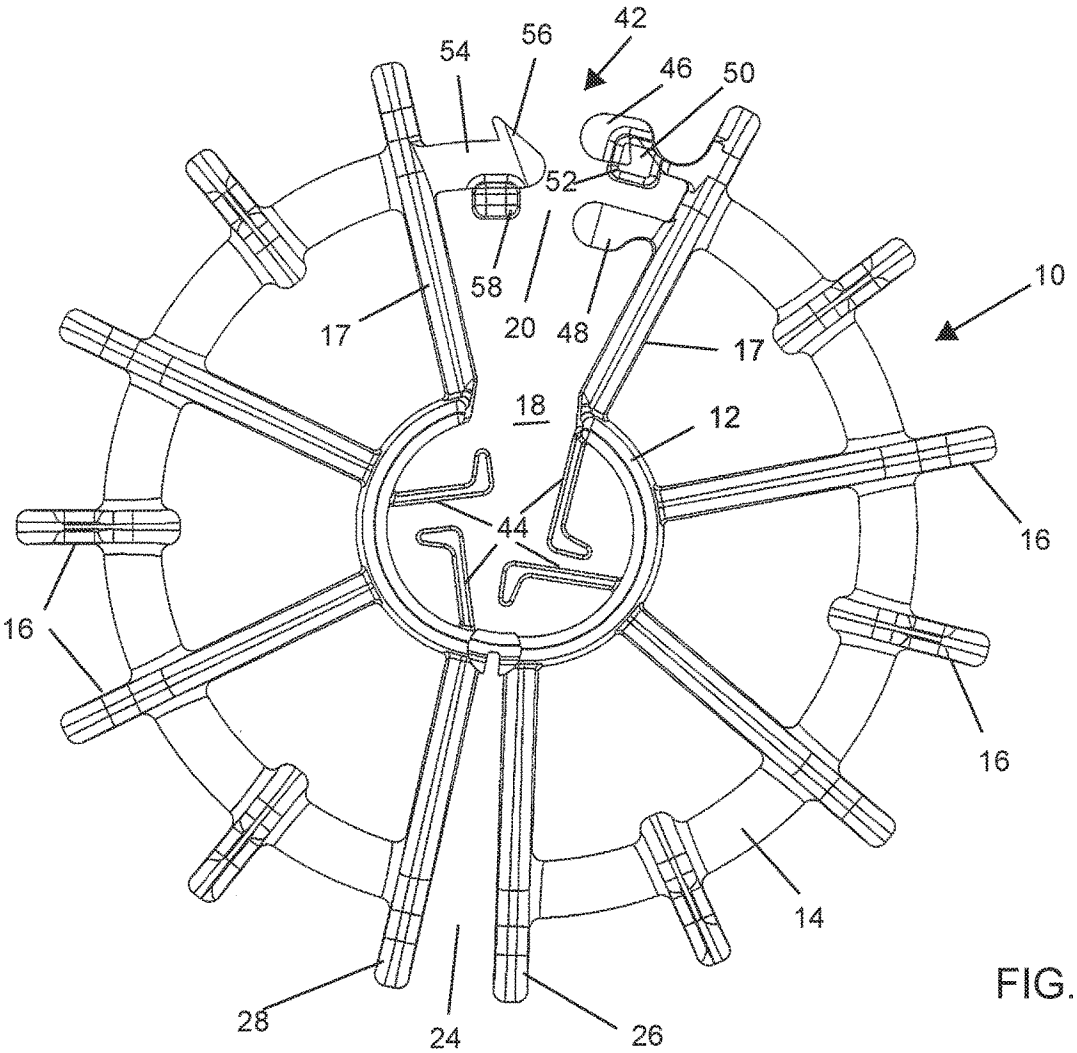
FIG. 6 is a side elevation view of another embodiment of the invention showing a different latch for the spacer.

Referring now to FIG. 6, there is illustrated another embodiment of the invention. This second embodiment is substantially similar to the embodiment of FIGS. 1-5 except for the latch. As in the first embodiment, the spacer 10 has spokes 16 extending outwardly from an inner ring 12 and an outer ring 14. The inner ring 12 has a gap 18 and the outer ring a gap 20 between two of the spokes 17 to accommodate a latch indicated generally by the reference numeral 42. The latch 42 in the gap 20 includes a yoke on one side of the gap 20, the yoke having spaced-apart, circumferentially extending arms 46 and 48. Outer arm 46 has on its inside surface a groove 50 and an alignment boss 52. (Groove 50 is partially hidden behind boss 52 in FIG. 6). On the opposite side of the gap 20 is a circumferentially extending arm 54 that has an outward extending hook 56 and an alignment boss 58 on the lower side. When the gap 20 is closed by squeezing together the two spokes 17 that form the gap 20, the arm 54 will move between the yoke arms 46 and 48. As the gap 20 closes, the hook 56 on arm 54 will become engaged in the groove 50 locking the arm 54 to the yoke arms 46 and 48. When so locked, the yoke arms 46 and 48 and the arm 54 cannot be separated by force in the circumferential direction. Because of the reverse tapers formed on the hook 56 and groove 50, attempts to disengage the hook 56 from the groove 50 will only tighten the lock. Similar to the first embodiment, the bosses 52 and 58 will prevent the arms 46 and 48 from separating from arm 54 and thus unlocking if sufficient force is applied in the axial direction, or if torsional force is exerted on the spacer 10 during the casting process.

Similar to the first embodiment, in order to assist in holding the spacer 10 on a horizontal cage wire 11 as the spacer is installed on the wire 11, four locking fingers 44 extend inwardly from the inner ring or hub 12. In this embodiment, the fingers 44 are somewhat L-shaped in cross section. The fingers 44 are spaced a substantially equal distance around the inside surface of hub 12, and each finger extends at about a 45° angle from a radial line.

The other difference between the spacer of the embodiment of FIG. 6 and the spacer of the first embodiment is that other than the spokes 17 adjacent to the gaps 18, 20 and 24, every other spoke 16 extends only outwardly from the outer ring 13, and they do not extend between the inner ring 12 and outer ring 14. This does not change the function of the spacer and reduces the amount of material and thus lowers the cost.

The spacer 10 can be manufactured with different dimensions depending upon the dimensions of the wire cage and the thickness of the concrete product being produced. This spacer has been designed to be used on many cages with 2" and 3" mesh as well as rolled cages. The size of the spacer 10 would be designed so as to provide a range of cover from ¾" up to 3" of cover, which is the distance between the cage and surface of the outside form or jacket. Obviously, the exact dimensions of the spacer will depend upon the size and spacing of the wires of the cage, but with the design of the spacer of the invention, a spacer of a size to provide 1" of cover, for example, will fit cages having different wire spacing.

It will be understood by those skilled in the art that a considerable number of spacers 10 will be installed on the wire cage at selected intervals before the cage is inserted over the core of the concrete forms. It will be evident from the above description that the spacers 10 can be quickly and easily installed without any tools. The quick installation will save considerable time and thus labor cost. When locked in place as described above, each spacer 10 is firmly locked in place so that it will not fall off the wire cage. Although the spacer 10 may turn slightly during the casting process, latch 22 will prevent the spacer 10 from becoming dislodged. Such turning movement of the spacer 10 is not sufficient to cause the spacer 10 to fall off the cage and will tend to absorb some of the forces exerted during lowering of the jacket over the wire cage and core. Such turning movement of the spacer 10 will not alter the amount of cover or the spacing effect of the spacer. The spacer 10 has no sharp edges, and the rounded ends of the spokes 16, 26 and 28 further minimize the forces on the spacer 10 as the outer-form or jacket is slipped down over the wire cage during the casting process. Once locked into place, the spacer 10 can withstand the considerable forces exerted during the entire casting process.

Having thus described the invention, it will be evident to those skilled in the art, that various other revisions and modifications can be made to the invention disclosed herein without departing from the spirit and scope of the invention. It is my intention however, that all such revisions and modifications that are obvious to those skilled in the art will be included within the scope of the following claims.

The invention claimed is:

1. A spacer for spacing a wire reinforcing cage from the forms used in making concrete products, the cage having spaced-apart horizontal and vertical wires, the spacer comprising:

an outer ring and an inner ring;

the inner ring forming a hub spaced radially from the outer ring for receiving a horizontal wire on a wire reinforcing cage;

spaced apart radially extending spokes connecting the outer ring and inner ring, the spokes having outer ends extending beyond the outer ring;

the outer ring and inner ring each having a gap between the same two adjacent spokes to provide for placing the spacer on a horizontal wire of a wire reinforcing cage with the wire extending through the hub;

a plurality of locking fingers inside the hub, the fingers extending at angles from radial lines to position the fingers to engage a horizontal wire on a wire reinforcing cage;

a latch formed in the outer ring at the gap in the outer ring, the latch being unlocked when the gap is open but becoming locked when the gap in the outer ring is closed by moving the two adjacent spokes toward each other; and the outer ring having a second gap diametrically opposite the first gap to facilitate locking the latch in the first gap of the outer ring.

2. A spacer for spacing a wire reinforcing cage from the forms used in making concrete products, the cage having spaced-apart horizontal and vertical wires, the spacer comprising:

an outer ring and an inner ring;

the inner ring forming a hub spaced radially from the outer ring for receiving a horizontal wire on a wire reinforcing cage;

spaced-apart radially extending spokes connecting the outer ring and inner ring, the spokes having outer ends extending beyond the outer ring;

the outer ring and inner ring each having a gap between the same two adjacent spokes to provide for placing the spacer on a horizontal wire of a wire reinforcing cage with the wire extending through the hub;

a plurality of locking fingers inside the hub, the fingers extending at angles from radial lines to position the fingers to engage a horizontal wire on a wire reinforcing cage;

a latch formed in the outer ring at the gap in the outer ring, the latch being unlocked when the gap is open but becoming locked when the gap in the outer ring is closed by moving the two adjacent spokes toward each other;

the latch being comprised of a yoke having spaced-apart arms on one side of the gap in the outer ring, and a single arm on the side of the gap opposite to the yoke, the single arm being aligned with the yoke so that when the two spokes adjacent to the gap in the outer ring are moved toward each other, the single arm will enter the yoke and lock the latch;

the arms of the yoke having a plurality of teeth and the single arm opposite the yoke having corresponding teeth, whereby the teeth on the single arm and on the yoke when engaged will lock the latch; and the yoke and the single arm opposite the yoke each have a boss positioned to prevent axial or torsional force from unlocking the latch.

3. A spacer for spacing a wire reinforcing cage from the forms used in making concrete products, the cage having spaced-apart horizontal and vertical wires, the spacer comprising:

an outer ring and an inner ring;

the inner ring forming a hub spaced radially from the outer ring for receiving a horizontal wire on a wire reinforcing cage;

spaced-apart radially extending spokes connecting the outer ring and inner ring, the spokes having outer ends extending beyond the outer ring;

the outer ring and inner ring each having a gap between the same two adjacent spokes to provide for placing the spacer on a horizontal wire of a wire reinforcing cage with the wire extending through the hub;

a plurality of locking fingers inside the hub, the fingers extending at angles from radial lines to position the fingers to engage a horizontal wire on a wire reinforcing cage;

a latch formed in the outer ring at the gap in the outer ring, the latch being unlocked when the gap is open but becoming locked when the gap in the outer ring is closed by moving the two adjacent spokes toward each other;

the latch being comprised of a yoke having spaced-apart arms on one side of the gap in the outer ring, and a single arm on the side of the gap opposite to the yoke, the single arm being aligned with the yoke so that when the two spokes adjacent to the gap in the outer ring are moved toward each other, the single arm will enter the yoke and lock the latch;

one of the arms of the yoke having a groove and the single arm opposite the yoke having a hook engageable with the groove, whereby the hook on the single arm and the groove in the yoke when engaged will lock the latch; and the yoke and the single arm opposite the yoke each having a boss positioned to prevent axial or torsional force from unlocking the latch.

* * * * *